US009041381B2

(12) United States Patent
Omoto et al.

(10) Patent No.: US 9,041,381 B2
(45) Date of Patent: May 26, 2015

(54) CURRENT MIRROR CIRCUITS IN DIFFERENT INTEGRATED CIRCUITS SHARING THE SAME CURRENT SOURCE

(71) Applicant: PRINCETON TECHNOLOGY CORPORATION, New Taipei (TW)

(72) Inventors: Fumikazu Omoto, New Taipei (TW); Chia Chu Chien, New Taipei (TW); Hwa Hsiang Chang, New Taipei (TW); Cheng Hsi Chen, New Taipei (TW)

(73) Assignee: PRINCETON TECHNOLOGY CORPORATION, New Taipei (TW)

( * ) Notice: Subject to any disclaimer, the term of this patent is extended or adjusted under 35 U.S.C. 154(b) by 212 days.

(21) Appl. No.: 13/676,715

(22) Filed: Nov. 14, 2012

(65) Prior Publication Data

US 2014/0132242 A1 May 15, 2014

(51) Int. Cl.
*G05F 3/16* (2006.01)
*G05F 3/26* (2006.01)

(52) U.S. Cl.
CPC ..... *G05F 3/262* (2013.01)

(58) Field of Classification Search
USPC ..... 323/312, 315, 317
See application file for complete search history.

(56) References Cited

U.S. PATENT DOCUMENTS

| | | | | |
|---|---|---|---|---|
| 6,166,590 | A * | 12/2000 | Friedman et al. | 323/314 |
| 6,538,495 | B2 * | 3/2003 | Goutti et al. | 327/538 |
| 7,420,529 | B2 * | 9/2008 | Abe et al. | 345/76 |
| 8,164,321 | B2 * | 4/2012 | Choy | 323/317 |
| 2004/0032293 | A1 * | 2/2004 | Maigret et al. | 327/540 |

* cited by examiner

*Primary Examiner* — Adolf Berhane
*Assistant Examiner* — Alex Torres-Rivera
(74) *Attorney, Agent, or Firm* — Muncy, Geissler, Olds & Lowe, P.C.

(57) ABSTRACT

A current mirror circuit, receiving an input current and outputting a plurality of mirroring currents, comprising: a first transistor, wherein a control terminal and a first terminal of the first transistor are connected to a first mirroring current of the input current; at least one second transistor, wherein a control terminal and a first terminal of the at least one second transistor are connected to the at least one second mirroring current of the input current; and a plurality of third transistors, outputting the plurality of mirroring currents from first terminals of the plurality of third transistors, wherein control terminals of the plurality of third transistors are connected to control terminals of the first transistor and the at least one second transistor. The first transistor, the at least one second transistor and the plurality of third transistors are identical.

3 Claims, 8 Drawing Sheets

CURRENT MIRROR CIRCUITS IN DIFFERENT INTEGRATED CIRCUITS SHARING THE SAME CURRENT SOURCE

BACKGROUND OF THE INVENTION

1. Field of the Invention

The invention relates to current mirror technology and more particularly to current mirror circuits in different ICs sharing the same current source.

2. Description of the Related Art

A current mirror circuit is often used to "mirror" (copy) a current of a current source (reference current) flowing through one transistor to at least one other transistor of the circuit. The current mirror circuit is typically used in equipment that requires current flowing through at least one electronic device to be exactly the same or at least be very close to each other. For example, the current mirror circuit may be utilized in display apparatuses using LEDs (Light Emitting Diodes), OLEDs (Organic Light Emitting Diodes), etc.

FIG. 1 illustrates a conventional PMOS (P-type Metal Oxide Semiconductor) current mirror circuit 10 of the prior art. The current mirror circuit 10 comprises PMOS transistors $P_M$ and $P_1$~$P_n$. Source terminals of the PMOS transistors $P_M$ and $P_1$~$P_n$ are connected to a voltage source Vdd. A gate terminal (control terminal) and a drain terminal of the PMOS transistor $P_M$ and gate terminals of the PMOS transistors $P_1$~$P_n$ are connected to a constant current source 100 generating a current $I_C$. In the current mirror circuit 10, the PMOS transistors $P_M$ and $P_1$~$P_n$ are assumed to be identical, and thus, output currents $I_1$~$I_n$ respectively flowing through the PMOS transistors $P_n$~$P_n$ are equal to the current $I_C$ flowing through the PMOS transistor $P_M$. However, since threshold voltages $V_t$ and constants β (depending on the transistor dimensions and material used for fabrication) of transistors are not completely identical in practice, the output currents $I_1$~$I_n$ are not exactly equal to the current Ic and to each other. The differences in the output currents $I_1$~$I_n$ may cause display apparatuses using LEDs or OLEDs to display images unevenly.

The differences may get worse when current mirror circuits in different ICs (Integrated Circuits) share the same current source. FIG. 2 illustrates a block diagram of a semiconductor device 20 comprising PMOS current mirror circuits in different ICs sharing the same current source according to an example of the prior art. The semiconductor device 20 comprises a master circuit 210 and a slave circuit 220. The master circuit 210 and the slave circuit 220 are provided on different ICs. A current mirror circuit 212 in the master circuit 210 and a current mirror circuit 222 in the slave circuit 220 shares the same constant current source 200 in the master circuit 210. The current mirror circuit 212 comprises PMOS transistors $P_M$ and $P_1$~$P_n$ and a current generating circuit 214. The current mirror circuit 222 comprises PMOS transistors $P_S$ and $P'_1$~$P'_n$. The current generating circuit 214 comprises NMOS (N-type Metal Oxide Semiconductor) transistors $NT_1$, $NT_2$ and $NT_3$ and receives a current $I_C$ from the constant current source 200. In order to provide the same reference current to the current mirror circuit 212 and the current mirror circuit 222, the current $I_C$ of the constant current source 200 is provided to the current mirror circuit 212 and the current mirror circuit 222 through a current mirror structure constructed by the NMOS transistors $NT_1$, $NT_2$ and $NT_3$. A gate terminal and a drain terminal of the NMOS transistor $NT_1$ and gate terminals of the NMOS transistors $NT_2$ and $NT_3$ are connected to the constant current source 200, and source terminals of the NMOS transistors $NT_1$, $NT_2$ and $NT_3$ are connected to a ground end. Thus, the current Ic of the constant current source 200 is mirrored from NMOS transistor $NT_1$ to NMOS transistors $NT_2$ and $NT_3$. A gate terminal and a drain terminal of the PMOS transistor $P_M$ and gate terminals of the PMOS transistors $P_1$~$P_n$ are connected to a drain terminal of the NMOS transistor $NT_2$. A gate terminal and a drain terminal of the PMOS transistor $P_S$ and gate terminals of the PMOS transistors $P'_1$~$P'_n$ are connected to a drain terminal of the NMOS transistor $NT_3$. In the semiconductor device 20, the PMOS transistors $P_M$, $P_1$~$P_n$, $P_S$ and $P'_1$~$P'_n$ are assumed to be identical, and the NMOS transistors $NT_1$, $NT_2$ and $NT_3$ are assumed to be identical. Thus, output currents $I_1$~$I_n$ and $I'_1$~$I'_n$ are all equal to the current $I_C$. However, since threshold voltages Vt and constants β of transistors in an IC are not completely identical in practice, even though the current $I_C$ is mirrored to the current mirror circuit 212 and the current mirror circuit 222 in different ICs, output currents between ICs may not be completely identical.

BRIEF SUMMARY OF THE INVENTION

In view of this, an embodiment of the invention provides a current mirror circuit receiving an input current and outputting a plurality of mirroring currents according to the input current, comprising: a current generating circuit, comprising an input terminal receiving the input current, a first output terminal outputting a first mirroring current according to the input current and at least one second output terminal outputting at least one second mirroring current according to the input current; a first transistor, wherein a control terminal and a first terminal of the first transistor are connected to the first output terminal of the current generating circuit, and a second terminal of the first transistor is connected to a first reference voltage; at least one second transistor, wherein a control terminal and a first terminal of the at least one second transistor are connected to the at least one second output terminal of the current generating circuit, and a second terminal of the at least one second transistor is connected to the first reference voltage; and a plurality of third transistors, outputting the plurality of mirroring currents from first terminals of the plurality of third transistors, wherein control terminals of the plurality of third transistors are connected to the first output terminal and the at least one second output terminal of the current generating circuit, and second terminals of the plurality of third transistors are connected to the first reference voltage, wherein the first transistor, the at least one second transistor and the plurality of third transistors are identical.

Another embodiment of the invention provides a semiconductor device, comprising: a master circuit, comprising: a constant current source, generating an input current; a first current mirror circuit, receiving the input current and outputting a plurality of master mirroring currents according to the input current, comprising: a first current generating circuit, comprising a first input terminal receiving the input current, a first output terminal outputting a first mirroring current according to the input current, at least one second output terminal outputting at least one second mirroring current according to the input current and a third output terminal outputting a third mirroring current according to the input current; a first transistor, wherein a control terminal and a first terminal of the first transistor are connected to the first output terminal of the first current generating circuit, and a second terminal of the first transistor is connected to a first reference voltage; at least one second transistor, wherein a control terminal and a first terminal of the at least one second transistor are connected to the at least one second output terminal of the first current generating circuit, and a second terminal of the at least one second transistor is connected to the first reference voltage; and a plurality of third transistors, outputting the plurality of master mirroring currents from first terminals of the plurality of third transistors, wherein control terminals of the plurality of third transistors are connected to the first output terminal and the at least one second output terminal of the first current generating circuit, and second terminals of the plurality of third transistors are connected to the first reference voltage; and a slave circuit, comprising: a second current mirror circuit, outputting a plurality of slave mirroring currents according to the input current, comprising: a second current generating circuit, comprising a second input terminal connected to the third output terminal of the first current generating circuit, a fourth output terminal outputting a fourth mirroring current according to the third mirroring current and at least one fifth output terminal outputting at least one fifth mirroring current according to the third mirroring current; a fourth transistor, wherein a control terminal and a first terminal of the fourth transistor are connected to the fourth output terminal of the second current generating circuit, and a second terminal of the fourth transistor is connected to the first reference voltage; at least one fifth transistor, wherein a control terminal and a first terminal of the at least one fifth transistor are connected to the at least one fifth output terminal of the second current generating circuit, and a second terminal of the at least one fifth transistor is connected to the first reference voltage; and a plurality of sixth transistors, outputting the plurality of slave mirroring currents from first terminals of the plurality of sixth transistors, wherein control terminals of the plurality of sixth transistors are connected to the fourth output terminal and the at least one fifth output terminal of the second current generating circuit, and second terminals of the plurality of sixth transistors are connected to the first reference voltage, wherein the first transistor, the at least one second transistor, the plurality of third transistors, the fourth transistor, the at least one fifth transistor and the plurality of sixth transistors are identical.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
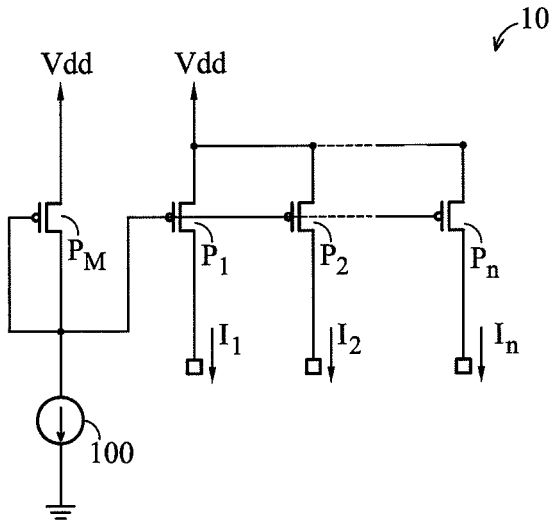
Fig. 1 ( Prior Art )
FIG. 1 illustrates a conventional PMOS current mirror circuit of the prior art.
Figure 2:
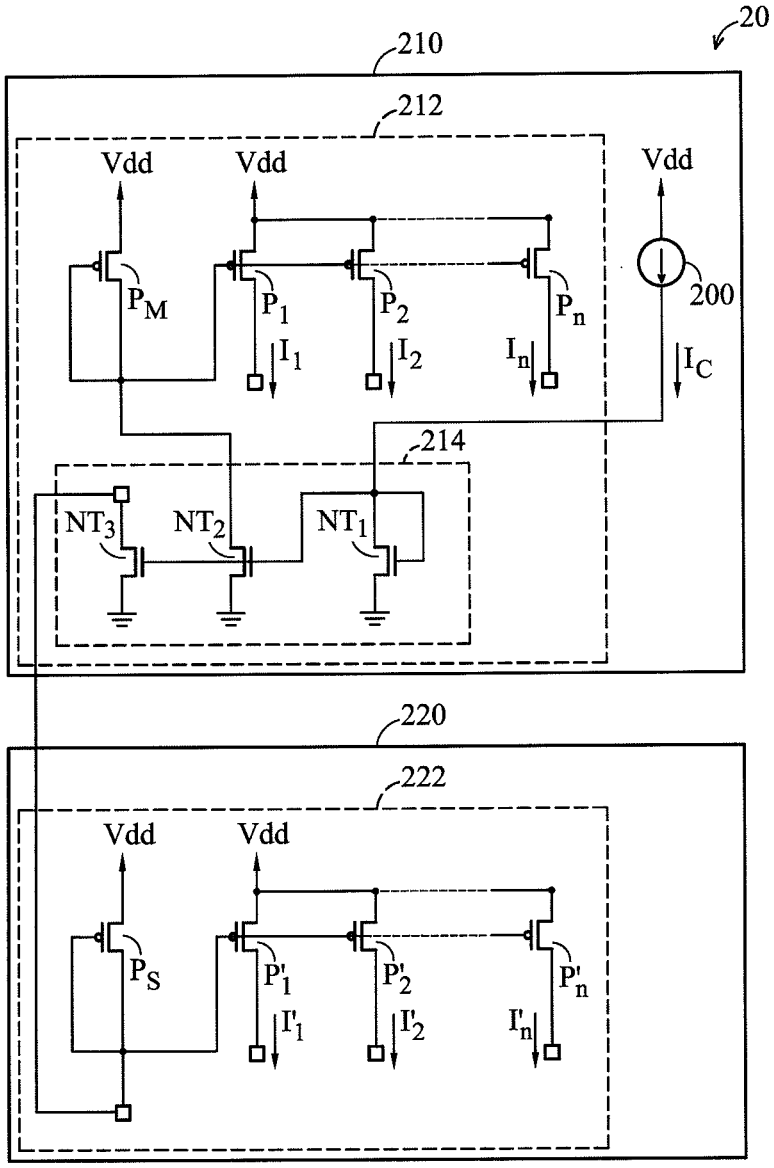
Fig. 2 ( Prior Art )
FIG. 2 illustrates a block diagram of a semiconductor device comprising PMOS current mirror circuits in different ICs sharing the same current source according to an example of the prior art.
Figure 3:
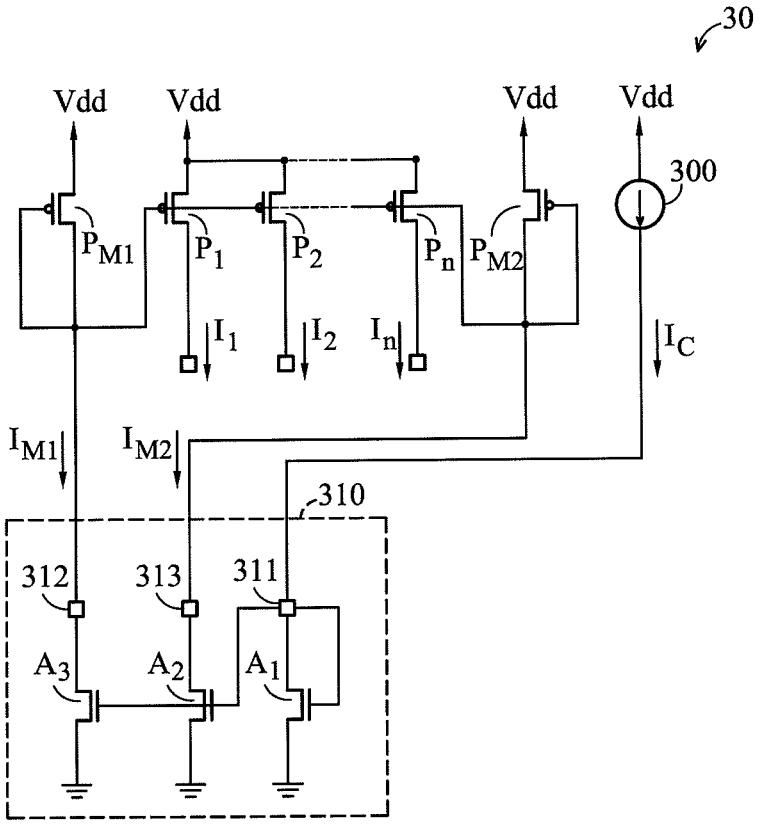
FIG. 3 illustrates a PMOS current mirror circuit according to an embodiment of the invention.

FIG. 3 illustrates a PMOS current mirror circuit 30 according to an embodiment of the invention. The PMOS current mirror circuit 30 comprises a current generating circuit 310 and PMOS transistors $P_{M1}$, $P_{M2}$ and $P_1$~$P_n$. The generating circuit 310 comprises NMOS (N-type Metal Oxide Semiconductor) transistors $A_1$, $A_2$ and $A_3$, an input terminal 311 receiving a current $I_C$ generated from a constant current source 300 and output terminals 312 and 313. The NMOS transistors $A_1$, $A_2$ and $A_3$ construct a current mirror structure mirroring the input current $I_C$ to the output terminals 312 and 313. Source terminals of the PMOS transistors $P_{M1}$, $P_{M2}$ and $P_1$~$P_n$ are connected to a voltage source Vdd. A gate terminal and a drain terminal of the PMOS transistor $P_{M1}$ are connected to the output terminal 312. A gate terminal and a drain terminal of the PMOS transistor $P_{M2}$ are connected to the output terminal 313. Gate terminals of the PMOS transistors $P_1$~$P_n$ are connected to the drain terminal of the PMOS transistor $P_{M1}$ and the drain terminal of the PMOS transistor $P_{M2}$ as shown in FIG. 3. In the current generating circuit 310, the NMOS transistors $A_1$, $A_2$ and $A_3$ are identical, and thus, mirroring currents $I_{M1}$ and $I_{M2}$ respectively flowing through the output terminals 312 and 313 are equal to the current $I_C$. In the current mirror circuit 30, the PMOS transistors $P_{M1}$, $P_{M2}$ and $P_1$~$P_n$ are identical, and thus, output currents $I_1$~$I_n$ respectively flowing through the PMOS transistors $P_1$~$P_n$ are equal to the current $I_C$.

In one example, the number of the PMOS transistor $P_{M2}$ may be more than one, and the number of the NMOS transistor $A_2$ is the same as the number of the PMOS transistor $P_{M2}$.

Figure 7:
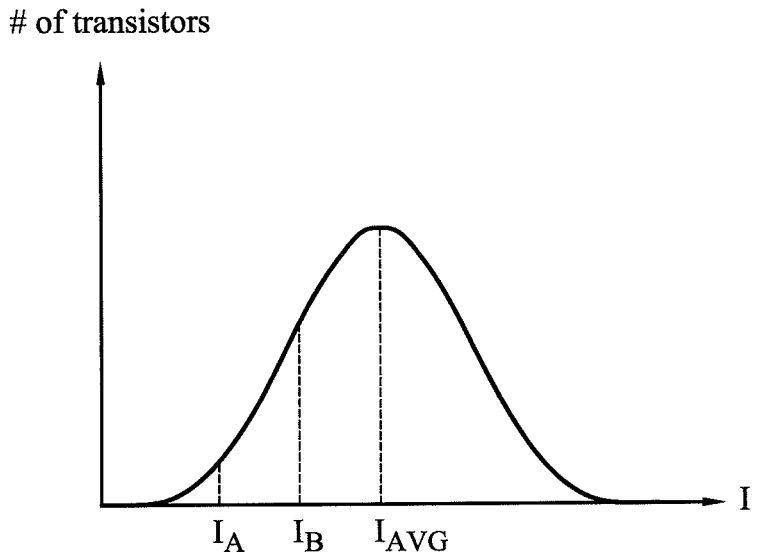
FIG. 7 illustrates a normal distribution of output currents of transistors.

Considering variations in threshold voltages $V_t$ and constants β of transistors, output currents of transistors (which are supposed to be identical) are assumed to have a normal distribution. Take FIG. 7 as an example, FIG. 7 illustrates a normal distribution of output currents I of transistors. Note that FIG. 7 is only an exemplary example and the invention is not limited thereto. Transistors in a current mirror circuit, such as the PMOS transistors $P_{M1}$ and $P_1$~$P_n$ in FIG. 3, are preferred to have an output current having the average value $I_{AVG}$ of the normal distribution. However, for example, if the PMOS transistor $P_{M1}$ in FIG. 3 has an output current $I_A$ in FIG. 7, differences between the output currents $I_1$~$I_n$ and the current $I_C$ may get worse since mismatch between the PMOS transistor $P_{M1}$ and the PMOS transistors $P_1$~$P_n$ gets worse. Assuming that the PMOS transistor $P_{M2}$ in FIG. 3 has an output current $I_B$ in FIG. 7, thus, the equivalent current of the PMOS transistor $P_{M1}$ and the PMOS transistor $P_{M2}$ gets closer to the average value $I_{AVG}$ than the PMOS transistor $P_{M1}$. Therefore, by introducing at least one PMOS transistor $P_{M2}$ into the current mirror circuit, differences of output currents may be improved. In other words, the PMOS transistors may reference not only the PMOS transistor $P_{M1}$ but also at least one PMOS transistor $P_{M2}$, and thus, differences of output currents may be obviated.

Figure 8:
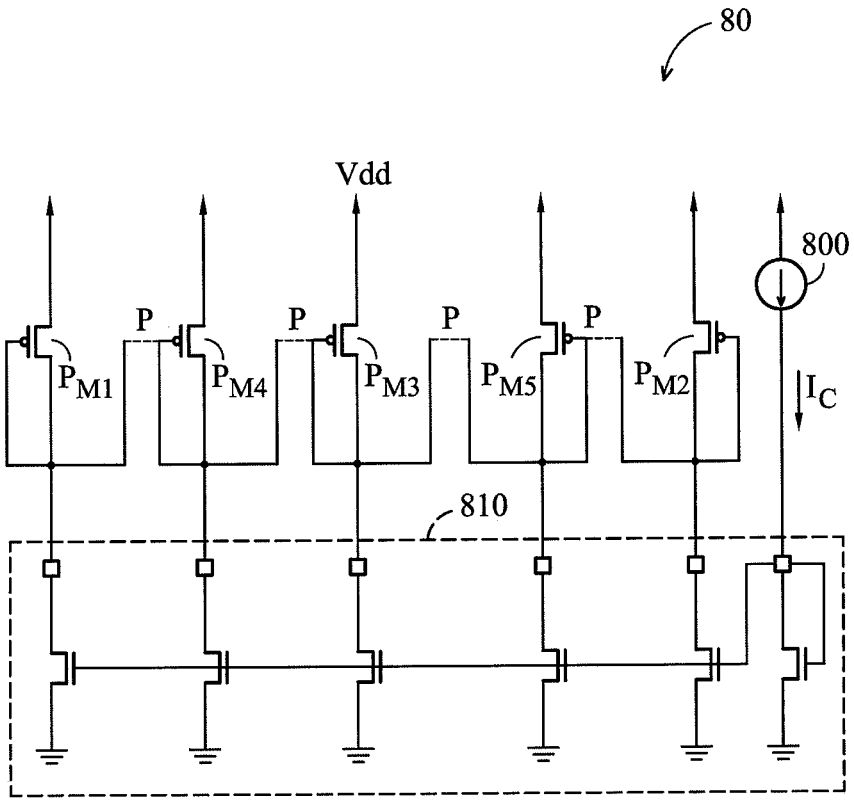
FIG. 8 illustrates a PMOS current mirror according to one embodiment of the invention.

In one example, the PMOS transistor $P_{M1}$ and the PMOS transistor $P_{M2}$ are preferred to be as far away from each other as possible in the circuit. For example, the PMOS transistor $P_{M1}$ and the PMOS transistor $P_{M2}$ are respectively provided at two ends of the current mirror circuit. FIG. 8 illustrates a PMOS current mirror 80 having more than one PMOS transistor $P_{M2}$ according to an embodiment of the invention. The PMOS current mirror 80 comprises a current generating circuit 810 which is similar to the current generating circuit 310 in FIG. 3 and PMOS transistors $P_{M1}$~$P_{M5}$ and a plurality of PMOS transistors P connected among the PMOS transistors $P_{M1}$~$P_{M5}$ (as show in dotted lines) for generating mirroring currents like the PMOS transistors $P_1$~$P_n$ in FIG. 3. A gate terminal and a drain terminal of each of the PMOS transistors $P_{M1}$~$P_{M5}$ are respectively connected to one output terminal of the current generating circuit 810. The PMOS transistor $P_{M3}$ may be provided in the middle between the PMOS transistor $P_{M1}$ and the PMOS transistor $P_{M2}$ as shown in FIG. 8. PMOS transistors $P_{M4}$ and $P_{M5}$ may be provided in the middle between $P_{M1}$ and $P_{M3}$ and in the middle between $P_{M3}$ and $P_{M2}$, respectively, and the rest may be provided in a similar fashion. The plurality of PMOS transistors P may be dispersedly arranged among the PMOS transistors $P_{M1}$~$P_{M5}$.

Figure 4:
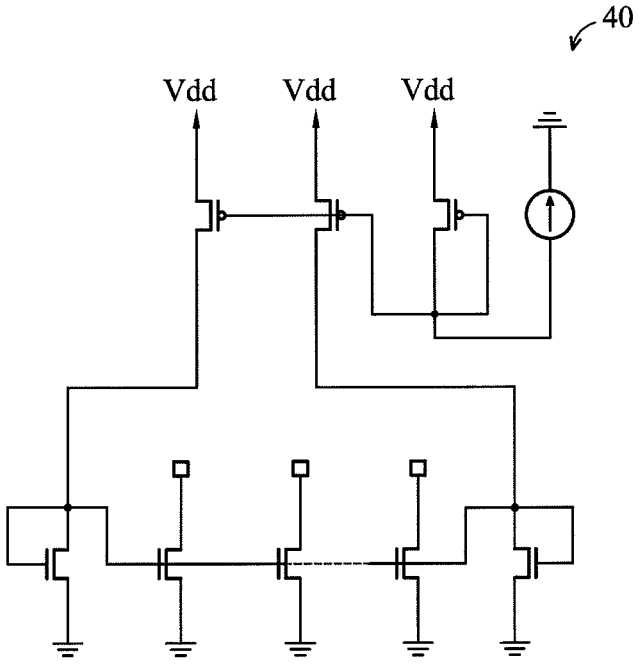
FIG. 4 illustrates an NMOS current mirror circuit according to an embodiment of the invention.

FIG. 4 illustrates an NMOS current mirror circuit 40 according to an embodiment of the invention. The NMOS current mirror circuit 40 is similar to the PMOS current mirror circuit 30 in FIG. 3 except that the PMOS transistors in FIG. 3 are replaced with the NMOS transistors of FIG. 4 and the NMOS transistors in FIG. 3 are replaced with the PMOS transistors of FIG. 4. Therefore, the NMOS current mirror circuit 40 is not described in detail here for brevity.

Figure 5:
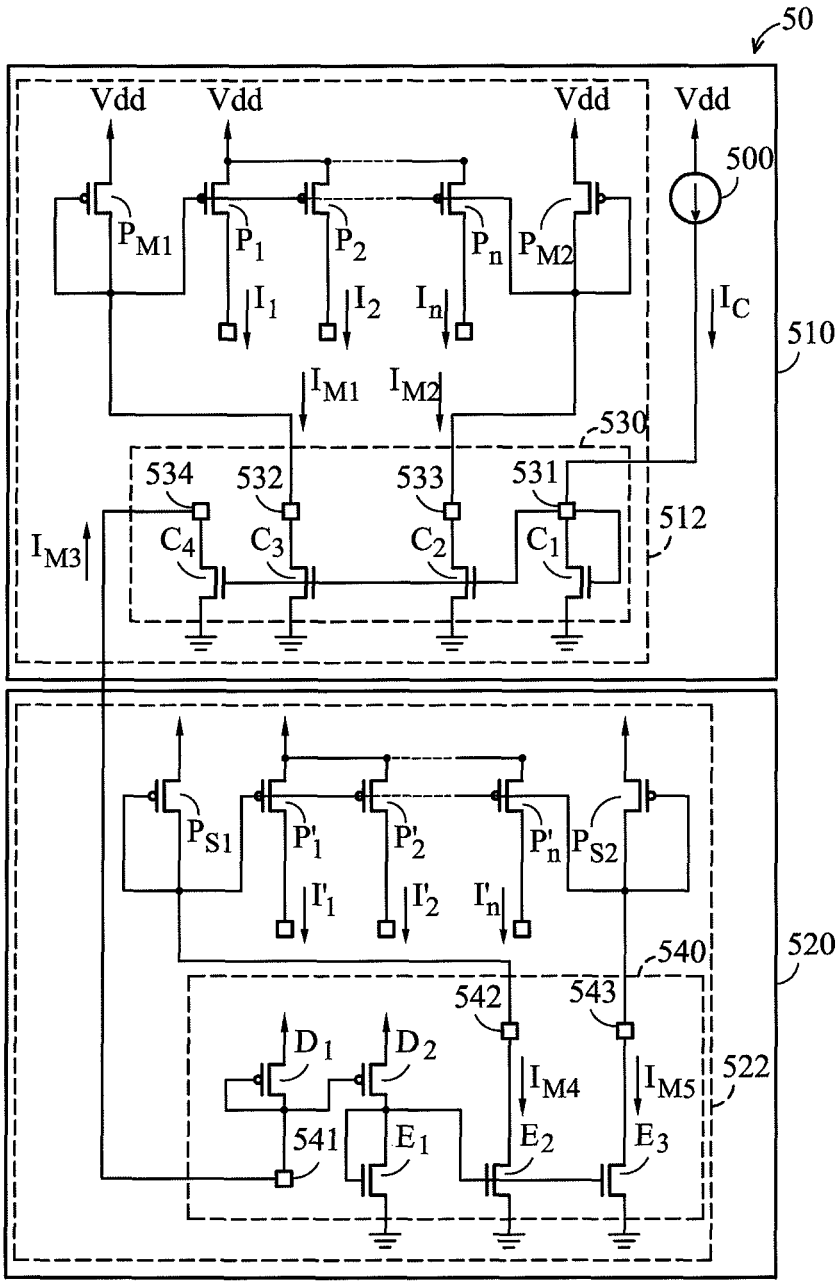
FIG. 5 illustrates a block diagram of a semiconductor device comprising PMOS current mirror circuits in different circuits sharing the same current source according to an embodiment of the invention.

FIG. 5 illustrates a block diagram of a semiconductor device 50 comprising PMOS current mirror circuits in different circuits sharing the same current source according to an embodiment of the invention. The semiconductor device 50 comprises a master circuit 510 and a slave circuit 520. The master circuit 510 and the slave circuit 520 are provided on different ICs. A current mirror circuit 512 in the master circuit 510 and a current mirror circuit 522 in the slave circuit 520 share the same constant current source 500 in the master circuit 510. The current mirror circuit 512 comprises a current generating circuit 530 and PMOS transistors $P_{M1}$, $P_{M2}$ and $P_1$~$P_n$. The current generating circuit 530 comprises NMOS transistors $C_1$, $C_2$, $C_3$ and $C_4$, an input terminal 531 receiving a current $I_C$ generated from a constant current source 500 and output terminals 532, 533 and 534. The NMOS transistors $C_1$, $C_2$, $C_3$ and $C_4$ construct a current mirror structure mirroring the input current $I_C$ to the output terminals 532, 533 and 534. Source terminals of the PMOS transistors $P_{M1}$, $P_{M2}$ and $P_1$~$P_n$ are connected to a voltage source Vdd. A gate terminal and a drain terminal of the PMOS transistor $P_{M1}$ are connected to the output terminal 532. A gate terminal and a drain terminal of the PMOS transistor $P_{M2}$ are connected to the output terminal 533. Gate terminals of the PMOS transistors $P_1$~$P_n$ are connected to the gate terminal of the PMOS transistor $P_{M1}$ and the gate terminal of the PMOS transistor $P_{M2}$ as shown in FIG. 5. In the current generating circuit 530, the NMOS transistors $C_1$, $C_2$, $C_3$ and $C_4$ are identical, and thus, mirroring currents $I_{M1}$, $I_{M2}$ and $I_{M3}$ respectively flowing through the output terminals 532, 533 and 534 are equal to the current $I_C$. In the current mirror circuit 512, the PMOS transistors $P_{M1}$, $P_{M2}$ and $P_1$~$P_n$ are identical, and thus, output currents $I_1$~$I_n$ respectively flowing through the PMOS transistors $P_1$·$P_n$ are equal to the current $I_C$. The current mirror circuit 522 comprises a current generating circuit 540 and PMOS transistors $P_{S1}$, $P_{S2}$ and $P'_1$~$P'_n$. The current generating circuit 540 comprises PMOS transistors $D_1$ and $D_2$, NMOS transistors $E_1$, $E_2$ and $E_3$, an input terminal 541 connected to the output terminal 534 of the current generating circuit 530 and receiving the mirroring current $I_{M3}$, and output terminals 542 and 543. The PMOS transistors $D_1$ and $D_2$ construct a first-level current mirror structure and the NMOS transistors $E_1$, $E_2$ and $E_3$ construct a second-level current mirror structure. The first-level current mirror structure and the second current mirror structure mirror the mirroring current $I_{M3}$ to the output terminals 542 and 543. Source terminals of the PMOS transistors $P_{S1}$, $P_{S2}$ and $P'_1$~$P'_n$ are connected to the voltage source Vdd. A gate terminal and a drain terminal of the PMOS transistor $P_{S1}$ are connected to the output terminal 542. A gate terminal and a drain terminal of the PMOS transistor $P_{S2}$ are connected to the output terminal 543. Gate terminals of the PMOS transistors $P'_1$~$P'_n$ are connected to the drain terminal of the PMOS transistor $P_{S1}$ and the drain terminal of the PMOS transistor $P_{S2}$ as shown in FIG. 5. In the current generating circuit 540, the PMOS transistors $D_1$ and $D_2$ are identical and the NMOS transistors $E_1$, $E_2$ and $E_3$ are identical, and thus, mirroring currents $I_{M4}$ and $I_{M5}$ respectively flowing through the output terminals 542 and 543 are equal to the mirroring current $I_{M3}$. Therefore, the mirroring currents $I_{M4}$ and $I_{M5}$ are equal to the current $I_C$. In the current mirror circuit 512, the PMOS transistor $P_{S1}$, $P_{S2}$ and $P'_1$~$P'_n$ are identical, and thus, output currents $I'_1$~$I'_n$ respectively flowing through the PMOS transistors $P'_1$~$P'_n$ are equal to the current $I_C$. Accordingly, even though the current mirror circuit 512 and the current mirror circuit 522 are in different ICs, they can provide output currents which are substantially identical with the help of the PMOS transistors $P_{S1}$ and $P_{S2}$.

Figure 6:
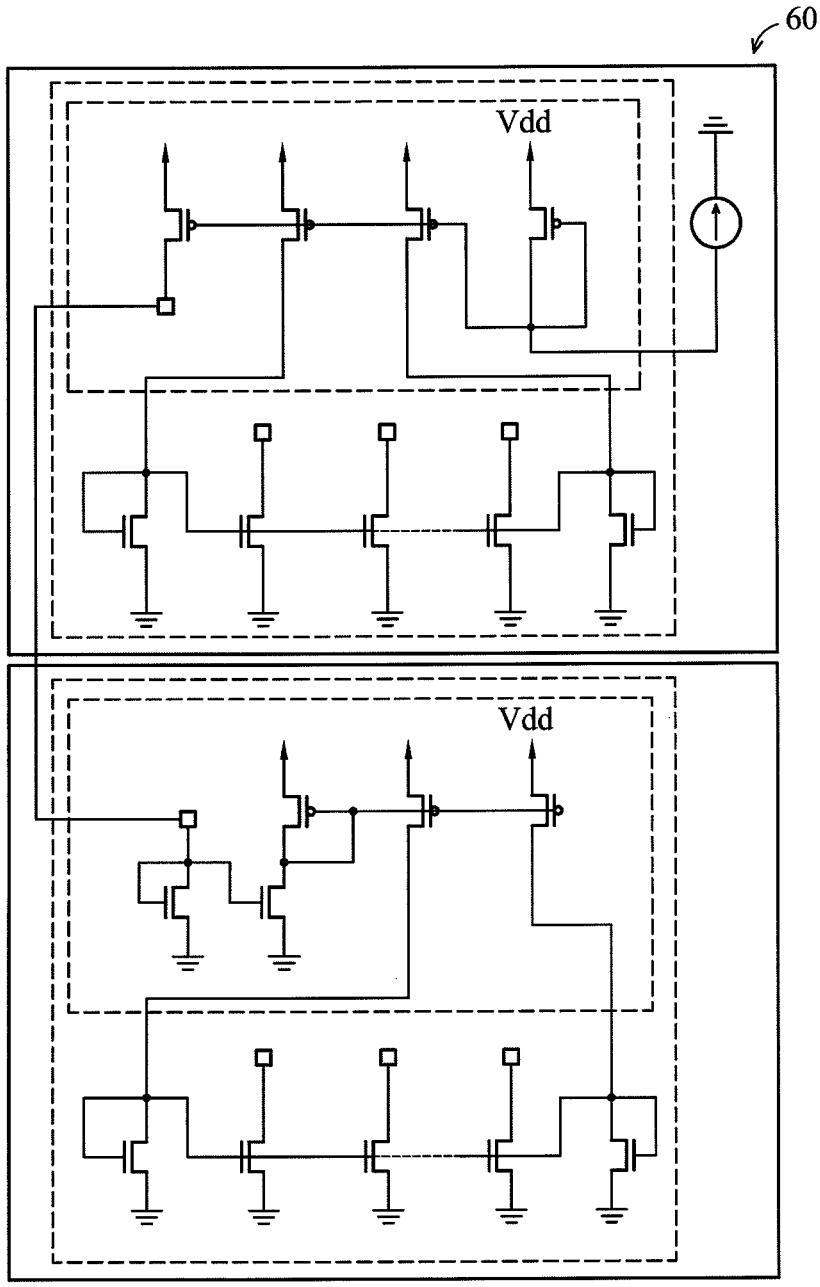
FIG. 6 illustrates a block diagram of a semiconductor device comprising NMOS current mirror circuits in different circuits sharing the same current source according to an embodiment of the invention.

FIG. 6 illustrates a block diagram of a semiconductor device 60 comprising NMOS current mirror circuits in different circuits sharing the same current source according to an embodiment of the invention. The semiconductor device 60 is similar to the semiconductor device 50 in FIG. 5 except that the PMOS transistors in FIG. 5 are replaced with the NMOS transistors of FIG. 6 and the NMOS transistors in FIG. 5 are replaced with the PMOS transistors of FIG. 6. Therefore, the semiconductor device 60 is not described in detail here for brevity.

As described above, the invention provides current mirror circuits that may improve the differences in output currents, especially in the case where current mirror circuits in different ICs share the same current source.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A semiconductor device, comprising:

a master circuit, comprising:

a constant current source, generating an input current;

a first current mirror circuit, receiving the input current and outputting a plurality of master mirroring currents according to the input current, comprising:

a first current generating circuit, comprising a first input terminal receiving the input current, a first output terminal outputting a first mirroring current according to the input current, at least one second output terminal outputting at least one second mirroring current according to the input current and a third output terminal outputting a third mirroring current according to the input current;

a first transistor, wherein a control terminal and a first terminal of the first transistor are connected to the first output terminal of the first current generating circuit, and a second terminal of the first transistor is connected to a first reference voltage;

at least one second transistor, wherein a control terminal and a first terminal of the at least one second transistor are connected to the at least one second output terminal of the first current generating circuit, and a second terminal of the at least one second transistor is connected to the first reference voltage; and a plurality of third transistors, outputting the plurality of master mirroring currents from first terminals of the plurality of third transistors, wherein control terminals of the plurality of third transistors are connected to the first output terminal and the at least one second output terminal of the first current generating circuit, and second terminals of the plurality of third transistors are connected to the first reference voltage, and the control terminal of each of the plurality of the third transistors is connected to the first output terminal and the at least one second output terminal of the first current generating circuit; and a slave circuit, comprising:

a second current mirror circuit, outputting a plurality of slave mirroring currents according to the input current, comprising:

a second current generating circuit, comprising a second input terminal connected to the third output terminal of the first current generating circuit, a fourth output terminal outputting a fourth mirroring current according to the third mirroring current and at least one fifth output terminal outputting at least one fifth mirroring current according to the third mirroring current;

a fourth transistor, wherein a control terminal and a first terminal of the fourth transistor are connected to the fourth output terminal of the second current generating circuit, and a second terminal of the fourth transistor is connected to the first reference voltage;

at least one fifth transistor, wherein a control terminal and a first terminal of the at least one fifth transistor are connected to the at least one fifth output terminal of the second current generating circuit, and a second terminal of the at least one fifth transistor is connected to the first reference voltage; and a plurality of sixth transistors, outputting the plurality of slave mirroring currents from first terminals of the plurality of sixth transistors, wherein control terminals of the plurality of sixth transistors are connected to the fourth output terminal and the at least one fifth output terminal of the second current generating circuit, and second terminals of the plurality of sixth transistors are connected to the first reference voltage, and the control terminal of each of the plurality of the sixth transistors is connected to the fourth output terminal and the at least one fifth output terminal of the second current generating circuit, wherein the first transistor, the at least one second transistor, the plurality of third transistors, the fourth transistor, the at least one fifth transistor and the plurality of sixth transistors are identical.

2. The current mirror circuit as claimed in claim 1, wherein the first transistor, the at least one second transistor, the plurality of third transistors, the fourth transistor, the at least one fifth transistor and the plurality of sixth transistors are P-type Metal Oxide Semiconductor (PMOS) transistors.

3. The current mirror circuit as claimed in claim 1, wherein the first transistor, the at least one second transistor, the plurality of third transistors, the fourth transistor, the at least one fifth transistor and the plurality of sixth transistors are N-type Metal Oxide Semiconductor (NMOS) transistors.

* * * * *